US009665043B2

(12) United States Patent
Funatani et al.

(10) Patent No.: US 9,665,043 B2
(45) Date of Patent: May 30, 2017

(54) IMAGE FORMING APPARATUS UTILIZING ADJUSTMENT TONER IMAGE

(71) Applicant: CANON KABUSHIKI KAISHA, Tokyo (JP)

(72) Inventors: Kazuhiro Funatani, Mishima (JP); Masanori Asai, Tokyo (JP); Shuji Saito, Suntou-gun (JP); Hiroyuki Seki, Suntou-gun (JP); Yasutaka Yagi, Mishima (JP); Tetsuichiro Fujimoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/980,542

(22) Filed: Dec. 28, 2015

(65) Prior Publication Data

US 2016/0187815 A1 Jun. 30, 2016

(30) Foreign Application Priority Data

Dec. 26, 2014 (JP) ..... 2014-266594

(51) Int. Cl.
*G03G 15/00* (2006.01)
*G03G 15/16* (2006.01)

(52) U.S. Cl.
CPC ... *G03G 15/161* (2013.01); *G03G 2215/1661* (2013.01)

(58) Field of Classification Search
CPC ..... G03G 15/5058; G03G 15/161; G03G 15/5041
USPC ..... 399/72
See application file for complete search history.

(56) References Cited

U.S. PATENT DOCUMENTS

2005/0276620 A1* 12/2005 Omata ..... G03G 15/168 399/49
2007/0268357 A1* 11/2007 Nagata ..... B41J 29/393 347/243
2008/0019739 A1 1/2008 Oouchi
2009/0003893 A1 1/2009 Nishikawa et al.
2010/0226694 A1 9/2010 Osawa et al.
(Continued)

FOREIGN PATENT DOCUMENTS

JP 2007-147967 A 6/2007
JP 2008-026701 A 2/2008
JP 2009-031739 A 2/2009
(Continued)

*Primary Examiner* — Billy Lactaoen
(74) *Attorney, Agent, or Firm* — Fitzpatrick, Cella, Harper & Scinto

(57) ABSTRACT

An image forming apparatus includes a controller for forming an adjustment toner image in a region corresponding to between a first region corresponding to a preceding sheet and a second region corresponding to a subsequent sheet, wherein the controller selectively executes a first mode for setting as a first length a gap between the adjustment image and a trailing edge of the first region and for setting as a second length a gap between the adjustment toner image and a leading end of the second region, or a second mode for setting as a third length a gap between the adjustment toner image and the trailing edge of the first region and for setting as a fourth length a gap between the adjustment image and the leading end of the second region. The third is shorter than the first, and the fourth length is longer than the first length.

12 Claims, 5 Drawing Sheets

(56) References Cited

U.S. PATENT DOCUMENTS

2015/0362876 A1 12/2015 Kataoka et al.

FOREIGN PATENT DOCUMENTS

JP 2010-204445 A 9/2010
JP 2012-113202 A 6/2012

* cited by examiner

IMAGE FORMING APPARATUS UTILIZING ADJUSTMENT TONER IMAGE

FIELD OF THE INVENTION AND RELATED ART

The present invention relates to an image forming apparatus such as a copying machine, a printer, a facsimile machine, or the like, which uses an electrophotographic or electrostatic recording method.

Generally speaking, an image forming apparatus which uses an electrophotographic or electrostatic recording method forms a toner image on an image bearing component such as an electrophotographic photosensitive component, an electrostatically recordable dielectric component, an intermediary transfer component, or the like, with the use of an optional image formation process. Then, the toner image is transferred onto a sheet of transfer medium such as recording paper with the use of a transferring means, and then, is fixed to the sheet of transfer medium by being subjected to heating or the like process.

The transferring means of many image forming apparatuses such as the one described above has a contacting component such as a transfer roller which is pressed on the image bearing component to form a transferring section, in which a toner image is transferred from the image bearing component onto transfer medium. The process of transferring a toner image with the use of a transfer roller is as follows. A transfer roller is electrically conductive and elastic, and is placed in contact with an image bearing component, forming thereby a transferring section. A sheet of transfer medium is introduced into the transferring section with a preset control timing, and is conveyed through the transferring section while remaining sandwiched between the image bearing component and transfer roller. While the sheet of transfer medium is conveyed through the transferring section, transfer voltage which is opposite in polarity from the toner charge is applied to the transfer roller. Thus, the toner image on the image bearing component is electrostatically moved onto the sheet of transfer medium.

Here, the area of the surface of an image bearing component, which comes into contact with a sheet of transfer medium in the transferring section, is referred to as "transfer medium area". Further, the area of surface of the image bearing component, which corresponds to the interval between two sheets of transfer medium which are being consecutively conveyed in a continuous image forming operation is referred to as a "transfer medium interval area". In the case of an image forming apparatus such as the above-described one, in order to minimize the downtime (period in which image cannot be outputted), or the like purpose, an adjustment toner image, which is for adjusting an image forming apparatus in various properties and is not transferred onto a sheet of transfer medium, is sometimes formed on the transfer medium interval area of the image bearing component.

For example, a patch (which is in specific pattern) for adjusting an image forming apparatus in image density and image tone, to compensate for the changes which are caused by the elapse of time, changes in environment, etc., is sometimes formed as an adjustment toner image, on the transfer medium interval area of the image bearing component. By forming the patch on the transfer medium interval area, detecting the density, or the like properties, of the patch, and adjusting an image formation process in setting, according to the results of the detection, it is possible to finely adjust the image forming apparatus in image density and image tone. Generally speaking, the patch density is detected by an optical sensor. As for the setting of the image formation process, an image forming apparatus is adjusted in development voltage which is to be applied to a developing means, in the intensity (amount) of the beam of light outputted by the exposing means to expose the photosensitive component, and the like factors.

Further, a toner image for supplying toner to the area of contact between an image bearing component and a cleaning component for cleaning the image bearing component, is sometimes formed as an adjustment toner image, on the transfer medium interval area of the image bearing component. More concretely, a cleaning blade for scraping away residual toner from the surface of an image bearing component while the image bearing component is moved is widely in use as a cleaning component for removing the toner (residual toner) remaining on the surface of the image bearing component after the transfer of the toner image onto a sheet of transfer medium. The cleaning blade is placed in contact with the image bearing component. If the friction between the cleaning blade and the surface of the image bearing component is excessively large, the cleaning blade vibrates, which results in the occurrence of strange noises, and/or the cleaning blade is buckled, and therefore, fails to properly clean the surface of the image bearing component, reducing thereby an image forming apparatus in image quality. Thus, a supply toner image is formed on the transfer medium interval area to supply the area of contact between the image bearing component and cleaning blade with toner to minimize the friction between the cleaning blade and the surface of the image bearing component, in order to prevent the occurrence of strange noises, and the buckling of the cleaning blade.

In a case where an adjustment toner image is formed on the transfer medium interval area as described above, the adjustment toner comes directly into contact with the transfer roller, in the transferring section, since the transfer roller is in contact with the image bearing component in the transferring section. Then, as the transfer roller rotates one full turn, it sometimes comes into contact with the back surface of the next sheet of transfer medium, contamination thereby the back surface, as the next sheet enters the transferring section.

Thus, Japanese Laid-open Patent Application No. 2007-147967 proposes the following. That is, according to this patent application, in a process for forming an adjustment toner image on the transfer medium interval area, the transfer medium interval area is always increased in length to increase the distance between the adjustment toner image and the next sheet of transfer medium to no less than the circumference of the transfer roller. In the case of the invention disclosed in Japanese Laid-open Patent Application No. 2007-147967, the occurrence of the contamination of the back surface of a sheet of transfer medium is prevented by preventing the toner having transferred onto the transfer roller from the adjustment toner image on the image bearing component, from coming into contact with the back surface of the next sheet of transfer medium after the full rotation of the transfer roller after the formation of the adjustment toner image. However, if the transfer medium interval area is always increased to make the distance between the adjustment toner image and the next sheet of transfer medium no less than the circumference of the transfer roller, an image forming apparatus is sometimes substantially decreased in throughput, that is, the number of images which can be outputted per unit length of time. This problem is larger when the frequency with which the adjustment toner image is formed on the transfer medium interval area in a continuous image forming operation is greater. Thus, this proposal is not desirable in a case where an image forming apparatus is operated in a high speed mode which is used for higher productivity.

SUMMARY OF THE INVENTION

According to an aspect of the present invention, there is provided an image forming apparatus comprising a movable image bearing member configured to carry a toner image; a toner image formation unit configured to form a toner image on said image bearing member; a contact member configured to form a transfer portion for transferring the toner image from said image bearing member onto a transfer material in contact with said image bearing member; a controller configured to form an adjustment toner image by said toner image formation unit in a region corresponding to between a first region corresponding to a preceding transfer material and a second region corresponding to a subsequent transfer material, with respect to a moving direction of said image bearing member; wherein said controller selectively executes a first mode for setting as a first length a gap between the adjustment toner image and a trailing edge of the first region in the moving direction of said image bearing member and for setting as a second length a gap between the adjustment toner image and a leading end of the second region, or a second mode for setting as a third length a gap between the adjustment toner image and the trailing edge of the first region and for setting as a fourth length a gap between the adjustment toner image and the leading end of the second region, wherein the third is shorter than the first, and the fourth length is longer than the first.

Further features of the present invention will become apparent from the following description of exemplary embodiments with reference to the attached drawings.

DESCRIPTION OF THE EMBODIMENTS

Image forming apparatuses which are in accordance with the present invention are described in detail with reference to appended drawings.

Embodiment 1

1. Overall Structure and Operation of Image Forming Apparatus

Figure 1:
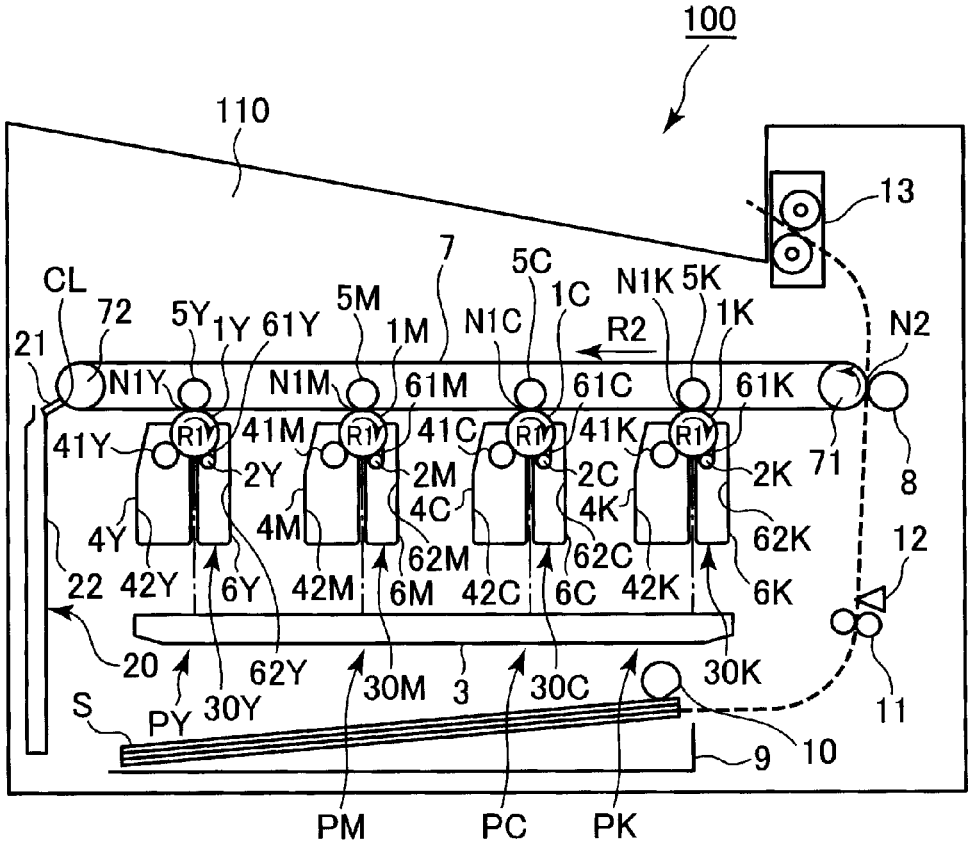
FIG. 1 is a schematic sectional view of the image forming apparatus in the first embodiment of the present invention.

FIG. 1 is a schematic sectional view of the image forming apparatus 100 in the first embodiment of the present invention. The image forming apparatus 100 in this embodiment is a laser beam printer of the so-called tandem type, and also, of the intermediary transfer type. It is capable of forming full-color images with the use of an electrophotographic image forming method.

The image forming apparatus 100 has four image forming sections PY, PM, PC and PK for forming yellow (Y), magenta (M), cyan (C) and black (K) monochromatic images, one for one, which are layered to from a full-color image. In this embodiment, the four image forming sections PY, PM, PC and PK are practically the same in structure and operation, although they are different in the color of the toner they use in the development process. Hereafter, therefore, unless they need to be differentiated, the suffixes which indicate the color of the images they form are not shown to describe the four image forming sections together.

The image forming apparatus 100 has a photosensitive drum 1 as the first image bearing component which is in the form of a rotatable drum (cylindrical). The photosensitive drum 1 is made up of an aluminum cylinder, and an organic photoconductive layer coated on the peripheral surface of the aluminum cylinder. It is rotationally driven in the direction indicated by an arrow mark R1 at a preset peripheral velocity by the driving force transmitted to the photosensitive drum 1 from a motor (unshown) as a driving means.

As the photosensitive drum 1 is rotated, the peripheral surface of the photosensitive drum 1 is uniformly charged by the charge roller 2 to preset polarity (negative in this embodiment) and polarity level. During the charging of the photosensitive drum 1, a preset charge voltage (charge bias) is applied to the charge roller 2 from a charge voltage power source 21 (FIG. 2) as a charge voltage applying means. The charge roller 2 is disposed in contact with the photosensitive drum 1.

The uniformly charged portion of the peripheral surface of the photosensitive drum 1 is scanned by a beam of laser light emitted from an exposing device 3 (laser scanner) as an exposing means, while modulated with image information regarding the color component of the image to be formed. As a given point of the uniformly charged portion of the peripheral surface of the photosensitive drum 1 is scanned (exposed), it changes in surface potential. Consequently, an electrostatic latent image is effected on the peripheral surface of the photosensitive drum 1.

The electrostatic latent image formed on the peripheral surface of the photosensitive drum 1 is developed into a visible image formed of toner (which hereafter will be referred to simply as toner image); developer (toner) is supplied to the electrostatic latent image by a developing device 4 as a developing means. The developing device 4 has a development roller 41 as a developer bearing component which is disposed so that it opposes the photosensitive drum 1. It conveys the toner stored in a developer storage section 42, to supply the photosensitive drum 1 with the developer. During the development, preset development voltage (development bias) is applied to the development roller 41 from a developer voltage power source 43 (FIG. 2) as a development voltage applying means. In this embodiment, a toner image is formed by a combination of the exposure of the image formation area and the reversal development. That is, in this embodiment, as the uniformly charged portion of the peripheral surface of the photosensitive drum 1 is scanned by (exposed to) the beam of laser light as described above, certain points of the exposed area are reduced in potential level (absolute value). It is to these exposed points that toner which is the same in polarity as the charge of the photosensitive drum 1 adheres. In this embodiment, toner that charges to the negative polarity is used as developer.

The image forming apparatus 100 has an intermediary transfer belt 7 as the second image bearing component, which is disposed in a manner to oppose the four photosensitive drums 1Y 1M, 1C and 1K. The intermediary transfer belt 7 is an endless belt and is circularly movable. It is suspended and kept tensioned by a pair of belt-suspending-tensioning rollers, more specifically, a driver roller 71 and a tension roller 72. As driving force is transmitted to the driver roller 71 from a motor (unshown) as a driving means, the driver roller 71 is rotationally driven by the driving force in the direction indicated by an arrow mark R2 in the drawing, at roughly the same peripheral velocity as the photosensitive drum 1. On the inward side of the loop (belt loop) which the intermediary transfer belt 7 forms, primary transfer rollers 5Y, 5M, 5C and 5K as the primary transferring components which are in the form of a roller are disposed. The primary transfer roller 5 is kept pressed toward the photosensitive drum 1 with the presence of the intermediary transfer belt 7 between itself and photosensitive drum 1, forming the primary transferring section N1 (primary transfer nip), that is, the area of contact between the intermediary transfer belt 7 and photosensitive drum 1. The toner image formed on the peripheral surface of the photosensitive drum 1 is electrostatically transferred (primary transfer) onto the intermediary transfer belt 7 by the function of the primary transfer roller 5. During this transfer, the primary transfer voltage (primary transfer bias) is applied to the primary transfer roller 5 from a primary transfer voltage power source 51 (FIG. 2) as a primary transfer applying means. The primary transfer voltage is DC voltage, and is the same in polarity as the charge (normal charge) which is given to toner to develop an electrostatic latent image. For example, in an operation for forming a full-color image, four monochromatic toner images which are different in color are formed on the photosensitive drums 1Y, 1M, 1C and 1K, one for one, and are sequentially transferred in layers onto the intermediary transfer belt 7, in the four primary transferring sections, one for one. Consequently, a multicolor toner image is effected on the intermediary transfer belt 7 by the four monochromatic toner images, different in color, layered on the intermediary transfer belt 7.

Figure 2:
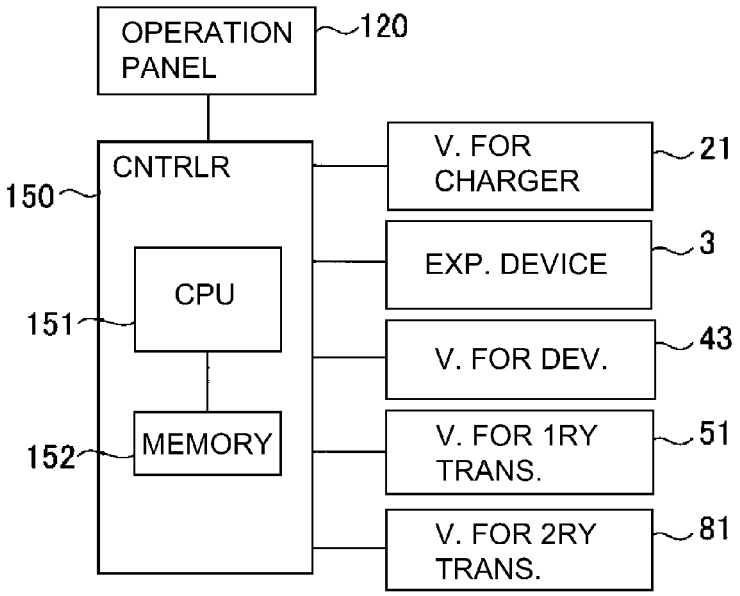
FIG. 2 is a block diagram of the image forming apparatus in the first embodiment, which is for showing the controlling of the essential sections of the apparatus.

On the outward side of the abovementioned loop (belt loop) which the intermediary transfer belt 7 forms, a secondary transfer roller 8 which is a secondary transferring component and is in the form of a roller is disposed as a secondary transferring means, in a manner to oppose the driver roller 71 (which doubles as belt-backing roller). The secondary transfer roller 8 is an example of contacting component which is disposed in a manner to press on the image bearing component (intermediary transfer belt 7) to form the transferring section in which a toner image is transferred from the image bearing component onto a sheet S of transfer medium. The secondary transfer roller 8 is kept pressed against the driver roller 71 with the presence of the intermediary transfer belt 7 between itself and the driver roller 71, forming the secondary transferring section N2 (secondary transfer nip), which is the area of contact between the intermediary transfer belt 7 and secondary transfer roller 8. The toner image formed on the intermediary transfer belt 7 is electrostatically transferred (secondary transferred) onto a sheet S of transfer medium such as recording paper by the function of the secondary transfer roller 8, in the secondary transferring section N2. During the secondary transfer, the secondary transfer voltage (secondary transfer bias) is applied to the secondary transfer roller 8 from a secondary transfer voltage power source 81 (FIG. 2). The secondary transfer voltage is DC voltage, and is opposite in polarity from the normal toner charge. For example, in an operation for forming a full-color image, the four monochromatic toner images, different in color, layered on the intermediary transfer belt 7 are transferred together onto the sheet S, in the secondary transferring section N2.

The sheet S of transfer medium is moved out of a transfer medium cassette 9 by a feeding-conveying roller 10, and is delivered to the secondary transferring section N2 by a pair of registration rollers 11, in synchronism with the movement of the toner image(s) on the intermediary transfer belt 7. In this embodiment, a combination of the transfer medium cassette 9, feeding-conveying roller 10, pair of registration rollers 11, etc., makes up a transfer medium supplying means which supplies the secondary transferring section N2 with a sheet S of transfer medium. In terms of the direction in which a sheet S of transfer medium is conveyed, a registration sensor 12 for detecting the timing of the passage of the leading and trailing edges of the sheet S is disposed on the downstream side of the pair of registration rollers 11. The feeding-conveying roller 10 and pair of registration rollers 11 convey the sheet S by being rotated by the driving force transmitted thereto from a motor (unshown) as a driving means. In this embodiment, a roller which is 14 mm in external diameter is used as the secondary transfer roller 8. Thus, the circumference of the secondary transfer roller 8 is roughly 44 mm.

After the transfer of a toner image onto a sheet S of transfer medium, the sheet S is conveyed to a fixing device 13 as a fixing means. In the fixing device 13, heat and pressure are applied to the sheet S and the toner image(s) thereon. Consequently, the toner image(s) becomes permanently fixed to the sheet S. Thereafter, the sheet S is discharged into a transfer medium delivery section, which is a part of the top surface of the main assembly 110 of the image forming apparatus 100.

By the way, the toner (residual toner) remaining on the peripheral surface of the photosensitive drum 1 after the primary transfer is removed from the photosensitive drum 1, and recovered, by a drum cleaning device 6 as a photosensitive component cleaning means. The drum cleaning device 6 has a cleaning blade 61 as a cleaning component for cleaning the photosensitive drum 1. The cleaning blade 61 is disposed in contact with the peripheral surface of the photosensitive drum 1. Thus, as the photosensitive drum 1 rotates, the drum cleaning device 6 scrapes away the residual toner from the peripheral surface of the photosensitive drum 1 with the use of the cleaning blade 61, and recovers the removed residual toner into a removed toner recovery container 62.

As for the toner (residual toner) remaining on the intermediary transfer belt 7 after the secondary transfer, it is removed from the intermediary transfer belt 7, and recovered, by a belt cleaning device 20 as an intermediary transfer belt cleaning device. The belt cleaning device 20 has a cleaning blade 21 as a cleaning component for cleaning the intermediary transfer belt 7, which is disposed in contact with the intermediary transfer belt 7. As the intermediary transfer belt 7 is circularly moved, the belt cleaning device 20 scrapes away the residual toner from the surface of the intermediary transfer belt 7 with the use of the cleaning blade 21, and recovers the removed residual toner into a container 22 for recovered toner.

In this embodiment, a combination of the photosensitive drum 1, charge roller 2, exposing device 3 used for the formation of images which are different in color, developing device 4, primary transfer roller 5, and drum cleaning device 6 make up an image forming section P as a toner image formation unit for forming a toner image on the intermediary transfer belt 7. Further, the photosensitive drum 1, charge roller 2 as the processing means for processing the photosensitive drum 1, developing device 4, and drum cleaning device 6 are integrated in the form of a process cartridge 30 which is removably installable in the main assembly 110 of the image forming apparatus 100.

The image forming apparatus 100 in this embodiment can be changed in its operational speed (process speed) in an image forming operation. That is, the image forming apparatus 100 in this embodiment is capable of forming images in any of multiple image formation modes which are different in the rotational speed of the photosensitive drum 1, and also, the moving speed of the intermediary transfer belt 7. Further, it is structured so that the image formation mode is selected based on the type of a sheet S of transfer medium which is to be conveyed to the second transferring section N2 so that a toner image can be transferred onto the sheet S in an image forming operation.

More specifically, in a case where high productivity is wanted, that is, in a case where ordinary paper is used as transfer medium, a relatively high operational speed is selected (high speed mode), whereas in a case where glossy paper is used to obtain glossy images, or card stock which makes it difficult for heat to be transferred to a toner image, is used, a relatively slow operational speed is selected (low speed mode). In this embodiment, in the high speed mode which is selected when ordinary paper is used as transfer medium, the operational speed (peripheral velocity of photosensitive drum 1, or moving speed of intermediary transfer belt 7) is set to 200 mm/sec. On the other hand, in the low speed mode which is selected when glossy paper or cardstock is used as transfer medium, the operational speed (peripheral surface of photosensitive drum 1 and moving speed of intermediary transfer belt 7) is set to 50 mm/sec, which is ¼ of the operation speed for the high speed mode.

In this embodiment, a control section 150 with which the apparatus main assembly 110 is provided can select image formation mode (high speed mode or low speed mode) in response to the signals which are sent from the control panel 120 (FIG. 2) with which the apparatus main assembly 110 is provided, to indicate the transfer medium selection made by an operator. Also in this embodiment, the controlling section 150 can select the image formation mode in response to the transfer medium selection signals sent from an external device such as a personal computer which is in connection to the controlling section 150 so that communication is possible between the controlling section 150 and external device. By the way, the image forming apparatus 100 may be provided with a sensor for detecting the type of a sheet S of transfer medium, so that the controlling section 150 is enabled to select the image formation mode based on the transfer medium type detected by the sensor. That is, the image forming apparatus 100 may be structured so that the information from a printer driver is used to determine the transfer medium type, or the results of the transfer medium type detection by a known means for detecting transfer medium type.

2. Control Sequence

FIG. 2 is a block diagram of the image forming apparatus 100 in this embodiment. It shows the controlling of the essential sections of the image forming apparatus 100. The control section 150 is the controlling means of the image forming apparatus 100. It comprises: a CPU 151 which is the central element for computation; and memory section 152 which includes such storage elements as ROM and RAM. In the RAM, the results of the detection by sensors, results of computation, etc., are stored. In the ROM, control programs, data tables prepared in advance, etc., are stored. The controlling section 150 integrally controls various sections of the image forming apparatus 100. The controlling section 150 is in connection to various sections which need to be controlled.

In this embodiment, the controlling section 150 is in connection to the charge voltage power source 21, exposing device 3, development voltage power source, laser scanner 43, primary transfer voltage power source 51, secondary transfer voltage power source 81, control panel 120, etc. In an image forming operation, the control section 150 selects the image formation mode based on the transfer medium selection signals sent from the control panel 120 and controls the image forming apparatus 100 in the adjustment toner image formation position (where on the transfer medium interval area (timing with which) an adjustment toner image is formed in an image forming operation), according to the selected image formation mode, as will be described later in detail.

Moreover, in this embodiment, the secondary transfer voltage power source 81 is enabled to selectively apply such DC voltage that is opposite (positive in this embodiment) in polarity from the normal toner charge, or such DC voltage that is the same (negative in this embodiment) as the normal toner charge, to the secondary transfer roller 8. The controlling section 150 is enabled to switch the secondary transfer voltage power source 81 in the polarity of the voltage to be applied to the secondary transfer roller 8 from the secondary transfer voltage power source 81, based on whether the voltage is applied to transfer a toner image onto a sheet S of transfer medium, or the adjustment toner image formed on the transfer medium interval area is moving through the secondary transferring section N2 as will be described later in detail.

3. Operation for Supplying Cleaning Blade with Toner

Next, a "toner supplying operation" which is an operation for supplying a cleaning section CL, which is the area of contact between the cleaning blade 21 of the belt cleaning device 20, and the intermediary transfer belt 7, is described.

In the toner supplying operation, a toner image which is to be conveyed to the cleaning section CL without being transferred onto a sheet S of transfer medium is formed. Here, this toner image may be referred to as a "lubricant toner image". The lubricant toner image is an example of adjustment toner image which is not transferred onto the sheet S. In comparison, a toner image which is formed in a normal image forming operation to be transferred onto the sheet S may be referred to as a "normal image". Further, the area of the photosensitive drum 1, on which the normal image is formed, and the area of the intermediary transfer belt 7, on which the normal image is formed, may be referred to as normal image areas. The normal image area (of photosensitive drum 1 or intermediary transfer belt 7) is the entirety of the surface of a sheet S of transfer medium minus the margin portions of the sheet S, which is the area of the sheet S across which no image is formed. Moreover, the area of the photosensitive drum 1, on which the lubricant toner image is formed, and the area of the intermediary transfer belt 7, on which the lubricant toner image is formed, may be referred to as "lubricant toner image areas".

Figure 3:
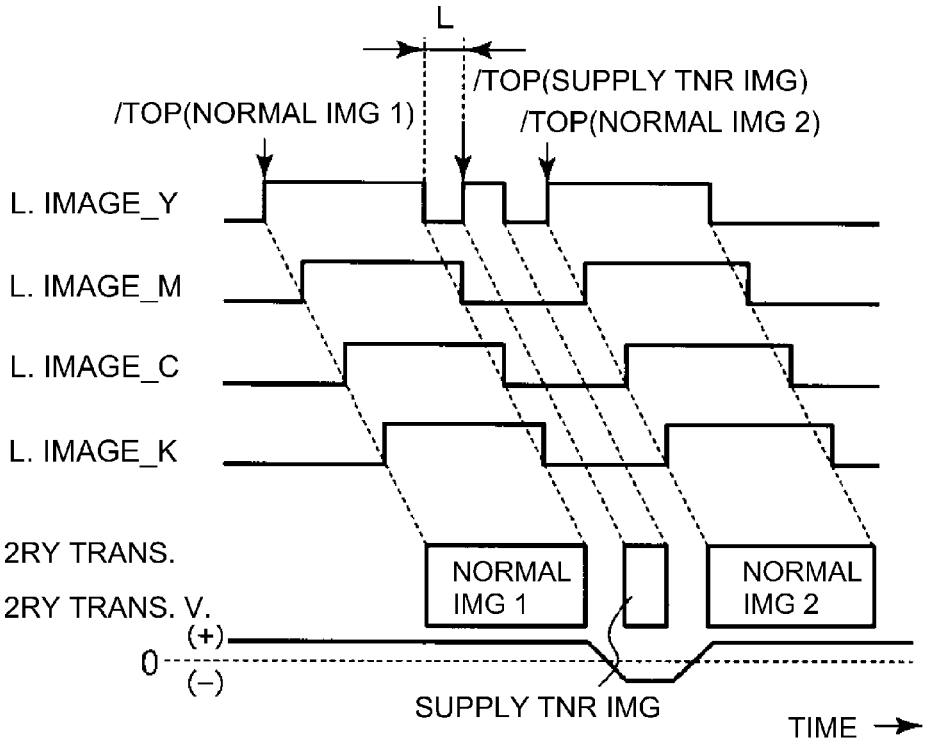
FIG. 3 is a timing chart which shows the timing with which a supply toner image is formed on the transfer medium interval area.

FIG. 3 is a timing chart which shows the timings with which the normal image and lubricant toner image are formed in a lubricant toner supplying operation. In this embodiment, in a continuous image forming operation in which multiple toner images are transferred in succession onto multiple sheets S of transfer medium, one for one, it is on all the intervals between the normal toner images that the lubricant toner image is formed. In terms of the direction (which hereafter may be referred to as "primary scan direction") which is roughly perpendicular to the moving direction (which hereafter may be referred to as "conveyance direction") of the peripheral surface of the photosensitive drum 1 and that of the intermediary transfer belt 7, the dimension (width) of the lubricant toner image is equal to the maximum width by which the peripheral surface of the photosensitive drum 1 can be exposed by the exposing device 3, for the following reason. That is, since the objective of the lubricant supplying operation is to reduce the friction between the cleaning blade 21 and intermediary transfer belt 7, it is desirable to prevent the friction between the cleaning blade 21 and intermediary transfer belt 7 becoming nonuniform in terms of the primary scan direction. Regarding the number of toners to be used for lubricant toner formation, all (four), or any three, two, or one of the four toners which are different in color, may be used.

In this embodiment, the lubricant toner image is formed of yellow toner alone. In terms of the conveyance direction, its dimension is 10 mm. In terms of the primary scan direction, its dimension is 216 mm (which is equal to dimension of maximum exposable area).

As voltage which is different in polarity from the toner charge is applied to the secondary transfer roller 8 while a sheet S of transfer medium is in the secondary transferring section N2, the normal image formed on the intermediary transfer belt 7 is transferred onto the sheet S. On the other hand, when the sheet S is not in the secondary transferring section N2, the lubricant toner image formed on the intermediary transfer belt 7 reaches the secondary transferring section N2. The voltage to be applied to the secondary transfer roller 8 is the same in polarity as the normal toner charge. That is, when the sheet S is not in the secondary transferring section N2, the voltage to be applied to the secondary transfer roller 8 is changed in polarity from negative to positive. Therefore, the toner in the lubricant toner image on the intermediary transfer belt 7 is prevented from adhering to the secondary transfer roller 8. That is, at least while the lubricant toner image is in contact with the secondary transfer roller 8, an electric field which is opposite in direction from the electric field formed in the secondary transferring section N2 to transfer a toner image from the intermediary transfer belt 7 onto the sheet S, is formed in the secondary transferring section N2. Thus, the lubricant toner image remains on the intermediary transfer belt 7, and is conveyed to the cleaning section CL, providing the area of contact between the cleaning blade 21 and intermediary transfer belt 7 with the toner from the lubricant toner image. Therefore, the friction between the cleaning blade 21 and the surface of the intermediary transfer belt 7 is reduced by the function of this toner. Therefore, the cleaning blade 21 is prevented from generating low frequency vibration, and/or buckling, therefore, the belt cleaning device 20 remains excellent in cleaning performance.

Here, an area of the surface of the intermediary transfer belt 7, which is in contact with a sheet S of transfer medium, in the secondary transferring section N2, is defined as "transfer medium area". Further, an area of the surface of the intermediary transfer belt 7, which corresponds to the interval between consecutively conveyed two sheets S of transfer medium is defined as "transfer medium interval area". In this embodiment, the length of the transfer medium interval area is set to 70 mm. Further, in this embodiment, the length of time necessary to change the secondary transfer voltage power source 81 in output polarity is 0.1 sec.

In the following section of the description of the embodiments of the present invention, unless specifically noted, the dimensions (distances) of the normal image, lubricant toner image, transfer medium area, transfer medium interval area, and margin are concerned with the conveyance direction. Further, regarding the orientation of the normal image, lubricant toner image, transfer medium area, transfer medium interval area, etc., the downstream side in terms of the conveyance direction may be referred to as "front", whereas the upstream side may be referred to as "rear".

Referring to FIG. 3, the controlling section 150 outputs a /TOP signal (normal image 1) for forming a normal image on the normal image area. Then, the controlling section 150 outputs a /TOP signal (lubricant toner image) for forming a lubricant toner image on the lubricant toner image area, with a preset timing, based on the length of the normal image to be formed. Then, the controlling section 150 outputs a /TOP signal (normal image 2) for forming the next normal image, with a preset timing. The abovementioned /TOP signal (lubricant toner image) is outputted with the following timing:

/TOP signal(lubricant toner image)=/TOP signal(normal image 1)+normal image length+distance $L$ from preceding normal image.

As the four image forming sections P receive /TOP signals, they sequentially form toner images through the above-described process. The formed toner images arrive at the secondary transferring section N2. Then, while a normal image(s) is moving through the secondary transferring section N2, the controlling section 150 applies to the secondary transfer roller 8, such secondary transfer voltage that is opposite in polarity from the normal toner charge, whereas while a lubricant toner image is moving through the secondary transferring section N2, the controlling section 150 applies to the secondary transfer roller 8, such voltage that is the same in polarity as the normal toner charge, to prevent toner from adhering to the secondary transfer roller 8. That is, all that is necessary is to ensure that it is after the voltage to be applied to the secondary transfer roller 8 is changed in polarity that a lubricant toner image arrives at the secondary transferring section N2. Thereafter, the controlling section 150 controls the image forming apparatus 100 so that the next normal image arrives at the secondary transferring section N2 after the voltage to be applied to the secondary transfer roller 8 is changed again in polarity.

Here, regarding the distance L from the preceding normal image to the lubricant toner image, in an operation in which images are formed with the provision of margins, the image forming apparatus 100 is controlled so that a lubricant toner image is formed on the transfer medium interval area in consideration of the dimension (length) of the downstream margin of the preceding normal image. Further, regarding the distance from the lubricant toner image to the following normal image, in an operation in which prints are formed with the provision of margins, the image forming apparatus 100 is controlled in consideration of the dimension (length) of the downstream margin of the following print so that a lubricant toner image is formed on the transfer medium interval area. More concretely, the controlling section 150 controls the image forming apparatus 100 in the normal image formation position and the lubricant toner image formation position (where on the intermediary transfer belt 7, normal image and lubricant toner image are formed), by controlling the timings with which the /TOP signals for forming the normal image and lubricant toner image are outputted. However, what is to be concerned with here is the positioning of a lubricant toner image on the transfer medium interval area. Hereafter, therefore, this embodiment is described primarily regarding the positional relationship between the transfer medium area, and the lubricant toner image to be formed on the transfer medium interval area.

4. Lubricant Toner Image

In this embodiment, in order to prevent the toner in a lubricant toner image from adhering to the secondary transfer roller 8, the voltage to be applied to the secondary transfer roller 8 is changed in polarity. However, it is rather difficult to perfectly prevent the problem that the toner in a lubricant toner image adheres to the secondary transfer roller 8, with the use of this method. That is, a certain portion of the toner in a lubricant toner image adheres to the secondary transfer roller 8. Thus, as the portion of the peripheral surface of the secondary transfer roller 8, which came into contact with the lubricant toner image, comes into contact with a sheet S of transfer medium after a full rotation of the secondary transfer roller 8 after the occurrence of the contact between the secondary transfer roller 8 and lubricant toner image, the toner on the secondary transfer roller 8 sometimes transfers onto the back surface of the sheet S, contaminating thereby the back surface of the sheet S.

One of the possible solutions to this problem of the contamination of the back surface of the sheet S of transfer medium is to make the distance from the rear end of an adjustment toner image and the immediately following sheet S of transfer medium longer than the circumference of the secondary transfer roller 8. With the use of this solution, as the secondary transfer roller 8 continues to rotate after coming into contact with the adjustment toner image, the portion of the peripheral surface of the secondary transfer roller 8, which came into contact with the adjustment toner image, moves again into the secondary transferring section N2 before the leading edge of the next sheet S of transfer medium enters the secondary transferring section N2. Therefore, it does not occur that while the secondary transfer roller 8 rotates one full turn after coming into contact with the adjustment toner image, the portion of the secondary transfer roller 8, which came into contact with the adjustment toner image, comes into contact with the immediately following sheet S of transfer medium. Moreover, while the secondary transfer roller 8 rotates one full turn after coming into contact with the adjustment toner image, the toner having transferred onto the peripheral surface of the secondary transfer roller 8 from the adjustment toner image is transferred back onto the intermediary transfer belt 7. Therefore, it does not occur that the toner from the adjustment toner image transfers onto the sheet S of transfer medium from the secondary transfer roller 8.

However, if the transfer medium interval area is always increased in length to make the distance between an adjustment toner image and the next sheet S of transfer medium greater than the circumference of the secondary transfer roller 8, the image forming apparatus 100 is sometimes substantially reduced in throughput. Therefore, in a case where the image forming apparatus 100 is operated in the high speed mode (high productivity mode), for example, a mode in which ordinary paper is used as transfer medium, it is desired to make the length of the transfer medium interval area as short as possible to minimize the throughput reduction.

The studies made by the inventors of the present invention revealed that as long as the amount of the toner having adhered to the secondary transfer roller 8 is smaller than a critical value, even if the toner on the secondary transfer roller 8 transfers onto the back surface of a sheet S of transfer medium, the contamination of the back surface of the sheet S is sometimes visually undetectable.

More concretely, the studies revealed that in an operation carried out in a high speed mode in which ordinary paper is used, as long as the amount of the toner having adhered to the secondary transfer roller 8 is smaller than a critical value, even if the portion of the peripheral surface of the secondary transfer roller 8, which came into contact with the lubricant toner image, comes into contact with a sheet S of transfer medium after the full rotation of the secondary transfer roller 8, the contamination of the back surface of the sheet S cannot be visually detected sometimes. This is thought to occur for the following reason. To begin with, the surface of ordinary paper is not as smooth as glossy paper which will be described later. Therefore, adhesion of a minute amount of toner to the back surface of a sheet S of ordinary paper is unlikely to change the appearance of the back surface in terms of contamination. Moreover, in the high speed mode, images are formed at a relatively high speed. Therefore, the amount by which heat is applied to the sheet S during fixation is relatively small. Therefore, it is difficult for the toner to melt. Therefore, even if toner adheres to the back surface of the sheet S, it is unlikely for the toner to increase the back surface contamination in density as it becomes fixed.

Table 1 shows the results of the studies of the relationship between the laser-ON ratio, which is the exposure ratio in the process for forming a lubricant toner image, and the amount of the back surface contamination of a sheet S of transfer medium which occurred when the image forming apparatus 100 was controlled so that the portion of the peripheral surface of the secondary transfer roller 8, which came in contact with a lubricant toner image, came into contact with the sheet S after one full rotation of the secondary transfer roller 8 after the occurrence of the contact between the secondary transfer roller 8 and the lubricant toner image.

TABLE 1

| Laser-ON ratio | Backside contamination (%) |
|---|---|
| 1.0 | 5.5 |
| 0.7 | 4.4 |
| 0.5 | 3.6 |
| 0.4 | 3.1 |
| 0.3 | 2.5 |
| 0.2 | 1.8 |
| 0.1 | 0.9 |
| 0 | 0 |

By the way, in this embodiment, the exposure ratio (laser-ON ratio) for the process for forming a lubricant toner image is defined by the following equation (1). In particular, in this embodiment, the adjustment toner image is a lubricant toner image, and the exposing means is the exposing device 3 (laser scanner). Thus, the output of the exposing means is the output of the laser scanner. That is, the laser-ON ratio is a value obtained by dividing the sum of the ratio of the laser output for each of the picture elements of a lubricant toner image relative to the maximum laser output, by the total number of picture elements of the lubricant toner image.

Exposure ratio is $$\frac{1}{n} \times \sum_{i=1}^{n} (E_i / E_0) \quad (1)$$

n: total number of picture elements on adjustment toner image formation area,

Ei: output of exposing means when the i-th picture element among total number (n) of picture elements is exposed, E0: maximum output of exposing means.

Further, in this embodiment, the amount of the back surface contamination of a sheet S of transfer medium is defined by the following equation (2), as the ratio by which the amount by which light is reflected by the sheet S is reduced:

Backside contamination is (Reflected light amount from no-backside-contamination area)−(Reflected light amount from backside-contamination area)/(Reflected light amount from no-backside-contamination area) (2)

Increase in the amount of back surface contamination of a sheet S of transfer medium worsens the sheet S in back surface contamination level. When the amount of back surface contamination of the sheet S is no more than 2% (threshold value), the contamination is hardly visually recognizable. In this embodiment, a white light photometer TC-6DS/A (product of Tokyo Denshoku Co., Ltd.) was used to measure the amount of light reflected by the sheet S.

As is evident from Table 1, as the laser-ON ratio was reduced to no more than 0.2, the amount of the back surface contamination of a sheet S of transfer medium fell to no more than 2%, making it impossible for the back surface contamination to be visually unrecognizable. This was thought to have occurred because the amount by which the toner adheres to the secondary transfer roller 8, and the amount by which the toner transfers onto the back surface of the sheet S, are sufficiently reduced. As described above, in the high speed mode in which ordinary paper is used as transfer medium, by setting the laser-ON ratio to 0.2, it is possible to reduce the amount by which toner is adhered to the back surface of the sheet S from the secondary transfer roller 8, to such a level that makes it impossible for the back contamination to be visually recognized.

However, in the low speed mode in which glossy paper is used, even when the laser-ON ratio was set to 0.2, as the portion of the secondary transfer roller 8, which came into contact with the lubricant toner image, came into contact with a sheet S of transfer medium after a full rotation of the secondary transfer roller 8, the back surface of the sheet S became unignorably soiled. This problem seems to have occurred for the following reason. To begin with, the surface of glossy paper is much smoother than the abovementioned ordinary paper. Therefore, the toner having adhered to the back surface of a sheet S of glossy paper is more easily recognizable than the toner having adhered to the back surface of a sheet S of ordinary paper. Therefore, when glossy paper is used as transfer medium, even if it is only a small amount of toner that adhered to the back surface of the sheet S, the contamination (by toner) is likely to be recognized. Further, when glossy paper is used as transfer medium, images are formed at a relatively slow speed. Therefore, the amount by which heat is given to the sheet S is relatively large. Therefore, the toner having adhered to the back surface of the sheet S of glossy paper more easily melts than the toner having adhered to the back surface of sheet S of ordinary paper. Therefore, when glossy paper is used as transfer medium, the back surface contamination of the sheet S is likely to be more conspicuous, even if the amount by which the toner adhered to the back surface of the sheet S is minute.

Table 2 shows the results of the studies of the relationship between the laser-ON ratio and the amount of the back surface contamination of a sheet S of transfer medium, when the image forming apparatus 100 was operated in the low speed mode in which glossy paper was used, and also, was controlled so that the portion of the peripheral surface of the secondary transfer roller 8, which came into contact with the lubricant toner image, came into contact with the sheet S after a full rotation of the secondary transfer roller 8.

TABLE 2

| Laser-ON ratio | Backside contamination (%) |
|---|---|
| 0.20 | 5.6 |
| 0.10 | 5.1 |
| 0.05 | 4.6 |
| 0.04 | 4.4 |
| 0.03 | 4.1 |
| 0.02 | 3.5 |
| 0.01 | 2.3 |
| 0 | 0 |

As will be evident from Table 2, in the low speed mode in which glossy paper is used, even when the laser-ON ratio was set as low as 0.01, the back surface contamination of the sheet S was visually recognizable. Further, the studies done by the inventors of the present invention revealed that as the laser-ON ratio is reduced to no more than 0.01, it sometimes occurs that the cleaning blade is insufficiently supplied with toner, and therefore, it becomes impossible to desirably reduce the friction between the cleaning blade 21 and the surface of the intermediary transfer belt 7. Thus, the laser-ON ratio (exposure ratio), which is defined by equation (1) given above, is desired to be no less than 0.01 and no more than 0.2.

Table 3 shows the results of the investigation of the relationship between the laser-ON ratio, and the amount of the back contamination of a sheet S of transfer medium, when the image forming apparatus 100 was operated in the low speed mode in which glossy paper was used as transfer medium, and the portion of the peripheral surface of the secondary transfer roller 8, which came in contact with a lubricant toner image, came into contact with the sheet S after two full rotations of the secondary transfer roller 8.

TABLE 3

| Laser-ON ratio | Backside contamination (%) |
|---|---|
| 1.0 | 5.5 |
| 0.7 | 4.4 |
| 0.5 | 3.6 |
| 0.4 | 3.1 |
| 0.3 | 2.5 |
| 0.2 | 1.8 |
| 0.1 | 0.9 |
| 0 | 0 |

As will be evident from Table 3, when the laser-ON ratio was set to no more than 0.2, the amount of the back surface contamination of the sheet S of transfer medium was no more than 2%, being therefore visually unrecognizable. This seems to have occurred for the following reason. That is, as the portion of the peripheral surface of the secondary transfer roller 8, which came in contact with the lubricant toner image, came into contact with the intermediary transfer belt 7 after a full rotation of the secondary transfer roller 8, the toner on the secondary transfer roller 8 was returned by a substantial amount to the intermediary transfer belt 7, reducing thereby the amount of the toner on the secondary transfer roller 8. Thus, the amount by which toner is transferred from the secondary transfer roller 8 onto the back surface of the sheet S after two full rotations of the secondary transfer roller 8 was substantially smaller. That is, in the low speed mode in which glossy paper is used as transfer medium, by setting the laser-ON ratio to 0.2, it is possible to keep the back surface contamination of the sheet S at a visually unrecognizable level, even if the portion of the peripheral surface of the secondary transfer roller 8, which came into contact with a lubricant toner image, comes into contact with the sheet S after two full rotations of the secondary transfer roller 8.

In this embodiment, therefore, the lubricant toner image was reduced in the amount (per unit area) of toner in comparison to solid image (highest in toner density) by using a halftone image as the lubricant toner image. That is, the amount by which toner transfers onto a sheet S of transfer medium as the portion of the peripheral surface of the secondary transfer roller 8, which came into contact with the lubricant toner image, comes into contact with the sheet S is reduced by reducing the amount (per unit area) by which toner adheres to the secondary transfer roller 8. With the use of this method, it is possible to lower the density level at which the back surface contamination of the sheet S, which occurs on the sheet S as the portion of the peripheral surface of the secondary transfer roller 8, which came into contact with the lubricant toner image, comes into contact with the sheet S, will occur, in order to make it difficult for the back surface contamination to be visually recognizable. More concretely, as described above, in the high speed mode, the image forming apparatus 100 is controlled so that even if the portion of the secondary transfer roller 8, which came into contact with a lubricant toner image, comes into contact with the sheet S after a full rotation of the secondary transfer roller 8, the resultant back surface contamination of the sheet S is visually unrecognizable. Further, in the low speed mode, the image forming apparatus 100 is controlled so that even if the portion of the secondary transfer roller 8, which came into contact with a lubricant toner image, comes into contact with the sheet S after two full rotations of the secondary transfer roller 8, the resultant back surface contamination of the sheet S is visually unrecognizable. In this embodiment, either in the high speed mode, or low speed mode, the laser-ON ratio is set to 0.2, based on the results of the above-described studies. Further, in order to make the portion of the peripheral surface of the secondary transfer roller 8, which came into contact with the lubricant toner image, come into contact with a sheet S of transfer medium as described, the lubricant toner image formation position on the transfer medium interval area (where on the transfer medium interval area a lubricant toner image is to be formed) is changed according to the image formation mode (whether the image forming apparatus 100 is in high speed or low speed mode).

5. Positioning of Lubricant Toner Image

Figure 4:
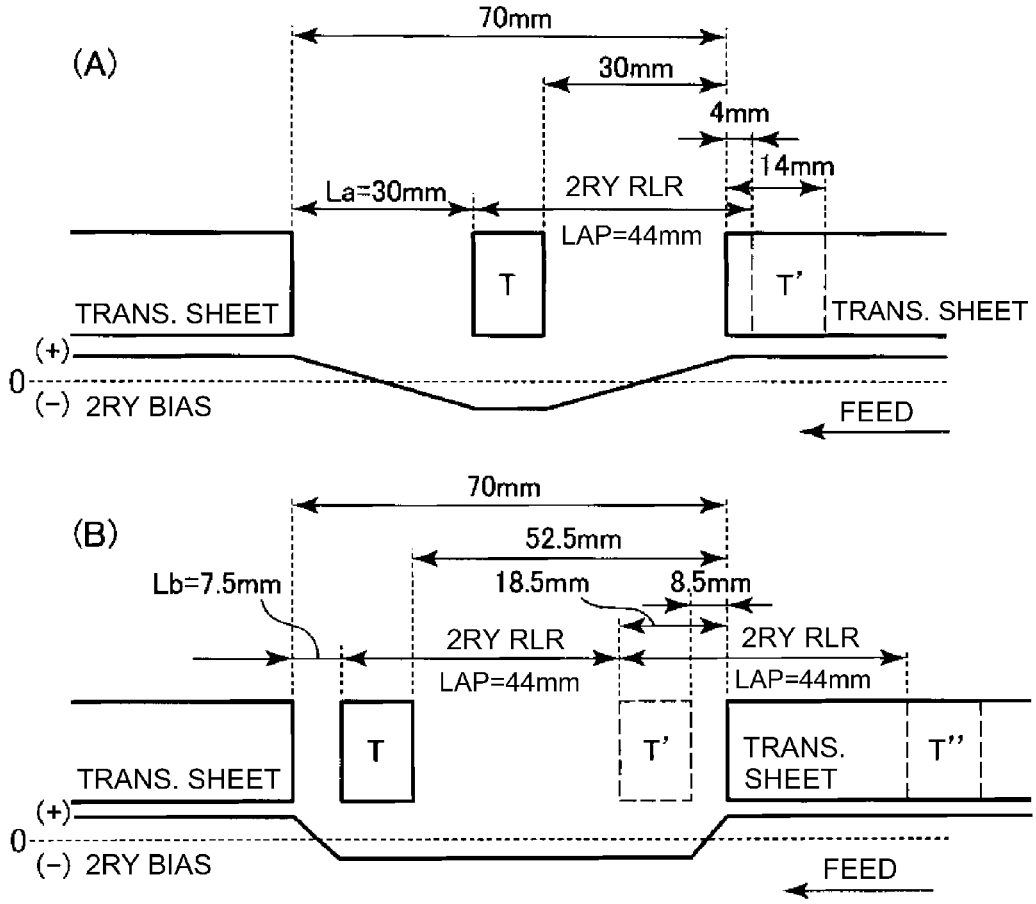
FIG. 4 is a schematic drawing for describing the positioning of the supply toner image, in the first embodiment.

Next, referring to FIG. 4, positioning of a lubricant toner image is described in greater detail. FIG. 4 is a schematic drawing for showing the relationship between image formation mode and positioning of a lubricant toner image. The horizontal direction in FIG. 4 corresponds to the length (distance, position) in terms of the conveyance direction. It shows the relationship between the polarity of the voltage to be applied to the secondary transfer roller 8, and the positions in which the above-described various areas are when they are in the secondary transferring section N2.

Referring to FIG. 4(A), in the high speed mode (200 mm/sec), the distance La between a lubricant toner image and the immediately preceding sheet S of transfer medium area is set to 30 mm (=200 mm/sec×0.15 sec). That is, the formation of a lubricant toner image is started with such a timing that the lubricant toner image arrives at the secondary transferring section N2 after the voltage to be applied to the secondary transfer roller 8 is changed in polarity.

Referring to FIG. 4(A), in this case, the portion of the peripheral surface of the secondary transfer roller 8, which came into contact with a lubricant toner image, reaches (position T' in drawing) again the secondary transferring section N2 as the secondary transfer roller 8 rotates one full rotation after the formation of the lubricant toner image (position T in drawing). This position T' is on the rear side, by 4-14 mm from the leading edge of the transfer medium area which immediately follows the lubricant toner image.

By the way, in the high speed mode, the distance from a lubricant toner image and the immediately following transfer medium area is set to 30 mm. Thus, the transfer medium area arrives at the secondary transferring section N2 after the voltage to be applied to the secondary transfer roller 8 is changed in polarity after the passage of the lubricant toner image through the secondary transferring section N2.

As described above, in the high speed mode, the image forming apparatus 100 is controlled so that the portion of the peripheral surface of the secondary transfer roller 8, which came into contact with a lubricant toner image, comes into contact with a sheet S of transfer medium after a full rotation of the secondary transfer roller 8. Further, a halftone image, which is substantially smaller in toner amount is formed as a lubricant toner image. Therefore, it is possible to achieve the objective of preventing a sheet S of transfer medium from suffering from the back surface contamination without reducing the image forming apparatus 100 in throughput, in the high speed mode, that is, the mode for higher productivity.

Next, referring to FIG. 4(B), in the low speed mode, a lubricant toner image is formed closer to the immediately preceding transfer medium area than in the high speed mode. More concretely, in the low speed mode (50 mm/sec), the distance Lb between a lubricant toner image and the immediately preceding transfer medium area is set to 7.5 mm (=50 mm/sec×0.15 sec). That is, the formation of a lubricant toner image is started with such a timing that the resultant lubricant toner image arrives at the secondary transferring section N2 immediately after the voltage to be applied to the secondary transfer roller 8 is changed in polarity immediately after the passage of the immediately preceding transfer medium area through the secondary transferring section N2.

In this case, the portion of the peripheral surface of the secondary transfer roller 8, which came into contact with a lubricant toner image, reaches again (position T' in drawing) the secondary transferring section N2 after the secondary transfer roller 8 rotates a full rotation after the formation of the lubricant toner image (position T in drawing). This position T' is on the front side of the leading edge of the transfer medium area which immediately follows the lubricant toner image, by 18.5 mm-8.5 mm.

By the way, in the low speed mode, the distance between a lubricant toner image and the immediately following transfer medium area is set to 52.5 mm. Thus, the portion of the peripheral surface of the secondary transfer roller 8, which came into contact with a lubricant toner image, comes into contact with the intermediary transfer belt 7 after a full rotation of the secondary transfer roller 8 after the formation of the lubricant toner image. Also in the low speed mode, the distance between the position T' and the immediately following transfer medium area is 8.5 mm. Therefore, the immediately following transfer medium area arrives at the secondary transferring section N2 right after the voltage to be applied to the secondary transfer roller 8 is changed in polarity after the passage of the lubricant toner image through the secondary transferring section N2.

Further, the toner having adhered to the secondary transfer roller 8 is returned by a substantial amount to the intermediary transfer belt 7 by the voltage which is the same in polarity as the normal toner charge and is applied to the secondary transfer roller 8. Thus, the toner on the peripheral surface of the secondary transfer roller 8 is reduced by the substantial amount. Therefore, in a position T" in which the portion of the peripheral surface of the secondary transfer roller 8, which came into contact with the lubricant toner image, comes into contact with a sheet S of transfer medium after another full rotation of the secondary transfer roller 8, it is unlikely for the toner on the secondary transfer roller 8 to transfer onto the sheet S by a substantial amount, and therefore, it is unlikely for the back surface of the sheet S to be significantly soiled.

As described above, in the low speed mode, a lubricant toner image is formed closer to the immediately preceding transfer medium area to cause the portion of the peripheral surface of the secondary transfer roller 8, which came into contact with the lubricant toner image, to come into contact with a sheet S of transfer medium after two full rotations of the secondary transfer roller 8 after the occurrence of the contact between the secondary transfer roller 8 and lubricant toner image. Further, a halftone image which is substantially smaller in the amount of toner than a solid image, is formed as the lubricant toner image as in the high speed mode. Therefore, even in the low speed mode, the back surface contamination of the sheet S can be prevented without increasing the transfer medium area in length. Therefore, even in the low speed mode, it is possible to accomplish both an object of preventing throughput reduction, and an object of preventing the back surface contamination of the sheet S. More concretely, in the low speed mode, the distance between the lubricant toner image to be formed on the transfer medium interval area, and the immediately preceding transfer medium area is made shorter than in the high speed mode. Thus, the toner having adhered to the secondary transfer roller 8 in the transfer medium interval area can be returned to the intermediary transfer belt 7, to prevent the back surface contamination of the sheet S, without increasing the transfer medium interval area in length. Further, in comparison to a case where the toner is not returned from the secondary transfer roller 8 to the intermediary transfer belt 7, the laser-ON ratio for the lubricant toner image formation can be increased. Therefore, it is possible to ensure that the cleaning blade 21 remains at its desirable level in performance, without reducing the image forming apparatus 100 in productivity.

As described above, the image forming apparatus 100 in this embodiment has the controlling section 150 which can make the image forming apparatus 100 continuously form toner images on multiple sheets of transfer medium, which are delivered to the secondary transferring section N2. It makes the image forming apparatus 100 form adjustment toner images, which are not transferred onto a sheet S of transfer medium, on the transfer medium interval area, in a continuous image forming operation. Here, the area of the image bearing component, which comes into contact with a sheet S of transfer medium, is referred to as "transfer medium area", and the area of the image bearing component, which is between consecutive two transfer medium areas, is referred to as "transfer medium interval area". Further, the interval, in terms of the moving direction of the peripheral surface of the image bearing component, between the adjustment toner image on the image bearing component, and "transfer medium area" which immediately precedes the adjustment toner image is referred to as "front interval" whereas, the interval, in terms of the moving direction of the peripheral surface of the image bearing component, between the adjustment toner image on the image bearing component, and the transfer medium area which immediately follows the adjustment toner image is referred to as "rear interval". The controlling section 150 is enabled to make the image forming apparatus 100 selectively operate in the first or second mode. The first mode is such a mode that images are continuously formed with the front-interval and rear interval set to the first and second intervals, respectively. The second mode is such a mode that the images are continuously formed with the front interval set to the third length which is shorter than the first length, and the rear interval set to the fourth length which is greater than the second length. In this embodiment, the image forming apparatus 100 has the contacting component 8 which is in the form of a roller and forms the secondary transferring section N2 by being pressed against the image bearing component 7. In other words, in this embodiment, the controlling section 150 is enabled to make the image forming apparatus 100 selectively operate in the first or second mode. That is, the first mode is such a mode that images are continuously formed in such a manner that the portion of the peripheral surface of the roller, which came into contact with an adjustment toner image, comes into contact with a sheet S of transfer medium which is delivered to the secondary transferring section N2 immediately after the adjustment toner image after a full rotation of the roller. The second mode is such a mode that images are continuously formed in such a manner that the portion of the peripheral surface of the roller, which came into contact with the adjustment toner image, comes into contact with the transfer medium interval area of the image bearing component 7, on which the adjustment toner image is present, after a full rotation of the roller after the formation of the adjustment toner image.

In particular, in this embodiment, the speed at which image bearing component 7 is moved in the second mode is slower than that in the first mode. Also in this embodiment, the controlling section 150 changes the image forming apparatus 100 in the operational mode (first or second mode) based on the type of a sheet S of transfer medium which is delivered to the secondary transferring section N2. Further, in this embodiment, the controlling section 150 makes the first and second modes roughly the same in the length of the transfer medium interval area in terms of the moving direction of the image bearing component 7. Here, "roughly the same" means not only "exactly the same", but also, "different within a tolerable range", for example, "within a range of 20%". However, the controlling section 150 is allowed to make the second mode greater in the transfer medium interval area in terms of the moving direction of the image bearing component 7, than the first mode. Also in such a case, this embodiment can minimize the amount by which the transfer medium interval area is to be increased (Embodiment 2).

As described above, according to this embodiment, the low speed mode, which is likely to make the back surface contamination of a sheet S of transfer medium more conspicuous than the high speed mode, is made smaller than the high speed mode, in the front interval, which is the interval between a lubricant toner image, and the transfer medium area which immediately precedes the lubricant toner image. The low speed mode is less than the high speed mode in the speed with which the intermediary transfer component 7 moves through the secondary transferring section N2. Therefore, in the low speed mode, even if the front interval is reduced, a sufficient length of time is available to change in polarity the voltage to be applied to the secondary transfer component 8. Further, the low speed mode is made greater than the high speed mode, in the rear interval, which is the interval between a lubricant toner image, and the transfer medium area which immediately follows the lubricant toner image. Therefore, in the low speed mode, it is possible to lengthen the distance across which the toner having adhered to the secondary transfer component 8 is allowed to transfer onto the intermediary transfer component 7. Here, the front interval is shortened. Therefore, it is possible to increase the rear interval without increasing the transfer medium interval area in length. As described above, by increasing the rear interval by shortening the front interval, it is possible to increase the probability with which the toner having adhered to the secondary transfer component 8 is made to transfer back onto the intermediary transfer component 7 to reduce the amount by which toner transfers from the secondary transfer component 8 onto a sheet S of transfer medium, without increasing the transfer medium interval area in length. In particular, in a case where the secondary transfer component 8 is a roller (secondary transfer roller), the rear interval is increased by shortening the front interval, in order to prevent the portion of the peripheral surface of the secondary transfer component 8, which came into contact with a lubricant toner image, from coming into contact with the sheet S after a full rotation of the secondary transfer component 8. Therefore, it is possible to increase the probability with which the toner transfers onto the intermediary transfer component 7, by making the portion of the peripheral surface of the secondary transfer component 8, which came into contact with the lubricant toner image, come into contact with the intermediary transfer component 7 after a full rotation of the secondary transfer component 8, without increasing the transfer medium interval area in length.

By the way, in the foregoing description of this embodiment, it was assumed that in the high speed mode, ordinary paper was used, whereas in the low speed mode, glossy paper was used. However, even if the transfer medium used in the high speed mode is the same in type as that used in the low speed mode, the back surface contamination of the transfer medium is easier to visually recognize in the low speed mode than in the high speed mode, for the above-described reason. Therefore, this embodiment is applicable even in a case where ordinary paper is used in the low speed mode, for example, in a case where the transfer medium used in the low speed mode is the same as that used in the high speed mode. For example, it is possible that in order to output glossier images, an image forming apparatus will be changed in operational speed to increase the amount by which heat is applied for fixation. Further, even if the high speed mode and low speed mode are different in the type of transfer medium, the transfer medium to be used in the low speed mode is not limited to glossy paper. That is, it may be other types of transfer medium, for example, cardstock. Similarly, the transfer medium to be used in the high speed mode is not limited to ordinary paper. That is, it may be other type of transfer medium, for example, thin paper. Generally speaking, transfer mediums are classified according to basis weight, surface properties (smoothness, degree of smoothness). This does not means that the application of the present invention is limited by transfer medium type. Generally speaking, however, the greater the transfer medium in basis weight, the greater the amount of heat necessary for fixation. Therefore, it is desired that the greater the transfer medium in basis weight, the slower the operational speed is set. With the operational speed set slower, the easier to visually recognize the back surface contamination of transfer medium becomes. Also generally speaking, the less the transfer medium in surface smoothness, the more difficult to visually recognize the back surface contamination of transfer medium. However, the application of the present invention is not limited by the smoothness of the transfer medium surface (Embodiment 2).

Embodiment 2

Next, another embodiment of the present invention is described. The image forming apparatus in this embodiment is the same in basic structure and operation as the one in the first embodiment. Therefore, the elements of the image forming apparatus in this embodiment, which are the same in structure and function as the counterparts of the image forming apparatus in the first embodiment are given the same referential codes as those given to the counterparts, and are not described here.

In this first embodiment, the high speed mode and low speed mode were made different from each other in the position of the lubricant toner image formed on the transfer medium interval area in a continuous image forming operation. The back surface contamination of a sheet S of transfer medium in the low speed mode was described in detail with reference to an image forming operation in which glossy paper is used. As will be evident from the description of the first embodiment, the low speed mode is greater in the amount of heat given during fixation than the high speed mode. Therefore, the toner having adhered to the back surface of a sheet S of transfer medium is easier to visually recognize as the back surface contamination. This can be said regardless of the type of transfer medium type used in the low speed mode. However, how conspicuous the back surface contamination of the sheet S is also affected by the type of the sheet S as described above.

Generally speaking, the surface of cardstock is less smooth than that of glossy paper. Therefore, it is less than that of glossy paper, in the amount of increase in the density of the back surface contamination of a sheet S of transfer medium attributable to dot gain. Therefore, if the amount of the toner having adhered to the secondary transfer roller 8 is smaller than a certain value, it is sometimes impossible to visually recognize the back surface contamination of the sheet S.

Table 4 shows the results of the investigation of the relationship between the laser-ON ratio, and the amount of the back surface contamination of a sheet S of transfer medium, in a case where the image forming apparatus was structured so that the portion of the peripheral surface of the secondary transfer roller 8, which came into contact with a lubricant toner image, came into contact with the sheet S after a full rotation of the secondary transfer roller 8.

TABLE 4

| Laser-ON ratio | Backside contamination (%) |
|---|---|
| 1.0 | 5.5 |
| 0.7 | 4.4 |
| 0.5 | 3.6 |
| 0.4 | 3.1 |
| 0.3 | 2.5 |
| 0.2 | 1.8 |
| 0.1 | 0.9 |
| 0 | 0 |

As is evident from Table 4, when the laser-ON ratio was set to no more than 0.2, the amount of the back surface contamination of a sheet S of transfer medium became no more than 2%. Therefore, the back surface contamination of the sheet S was visually unrecognizable. These results were the same as those, shown in Table 1, of the image forming operation performed in the high speed mode.

In this embodiment, therefore, in the low speed mode, the distance between the lubricant toner image formed on the transfer medium interval area, and the transfer medium area which immediately precedes the lubricant toner image was made shorter than that in the high speed mode. In addition, in this embodiment, in the low speed mode, the distance between the lubricant toner image formed on the transfer medium interval area, and the transfer medium area which immediately follows the lubricant toner image, was changed according to the type of transfer medium used for image formation. More concretely, in a case where glossy paper is used in the low speed mode, the image forming apparatus is controlled so that the portion of the peripheral surface of the secondary transfer roller 8, which came into contact with a lubricant toner image, comes into contact with the sheet S after two full rotations of the secondary transfer roller 8, whereas in a case where glossy paper is used in the low speed mode, the portion comes into contact with the sheet S after one full rotation of the secondary transfer roller 8.

Further, in this embodiment, the length of the transfer medium interval area was set to be shorter than that in the first embodiment. To elaborate, in recent years, high voltage power sources seem to have been reduced in the length of time required to change their output voltage in polarity. One of these high voltage power sources can be employed as the power source for the voltage to be applied to the secondary transfer roller 8, to reduce the distance which is necessary for changing the output voltage of the power source in polarity. Thus, by employing one of these high voltage power source as the power source of the voltage to be applied to the secondary transfer roller 8, it is possible to reduce the distance which is necessary for changing the output voltage of the power source in polarity. Therefore, even in the case of an image forming apparatus which forms an adjustment toner image on the transfer medium interval area, the length of the transfer medium interval area can be reduced to improve the apparatus in throughput.

In this embodiment, the length of time required to change in polarity the output of the secondary transfer voltage power source 81 is 0.05 sec, which is shorter than in the first embodiment. Further, in this embodiment, the length of the transfer medium interval area for the high speed mode is set to 30 mm (length of transfer medium interval area for low speed mode will be described later). Moreover, this embodiment is the same as the first embodiment, in the operational speed in the high speed mode which is selected when ordinary paper is used, and also, in the operational speed in the low speed mode which is selected when glossy paper or cardstock is used. Furthermore, this embodiment is the same as the first embodiment in the length of the lubricant toner image, external diameter (circumference) of the secondary transfer roller 8, and laser-ON ratio for the formation of a lubricant toner image. Further, in this embodiment, the formation of a lubricant toner image is started with such a timing that the lubricant toner image arrives at the secondary transferring section N2 right after the process to be started to change in polarity the voltage to be applied to the secondary transfer roller 8 after the passage of the immediately preceding transfer medium area, is ended, as in the first embodiment. That is, also in this embodiment, the slower the operational speed, the smaller the distance between the lubricant toner image and the immediately preceding transfer medium area is made, as in the first embodiment.

Figure 5:
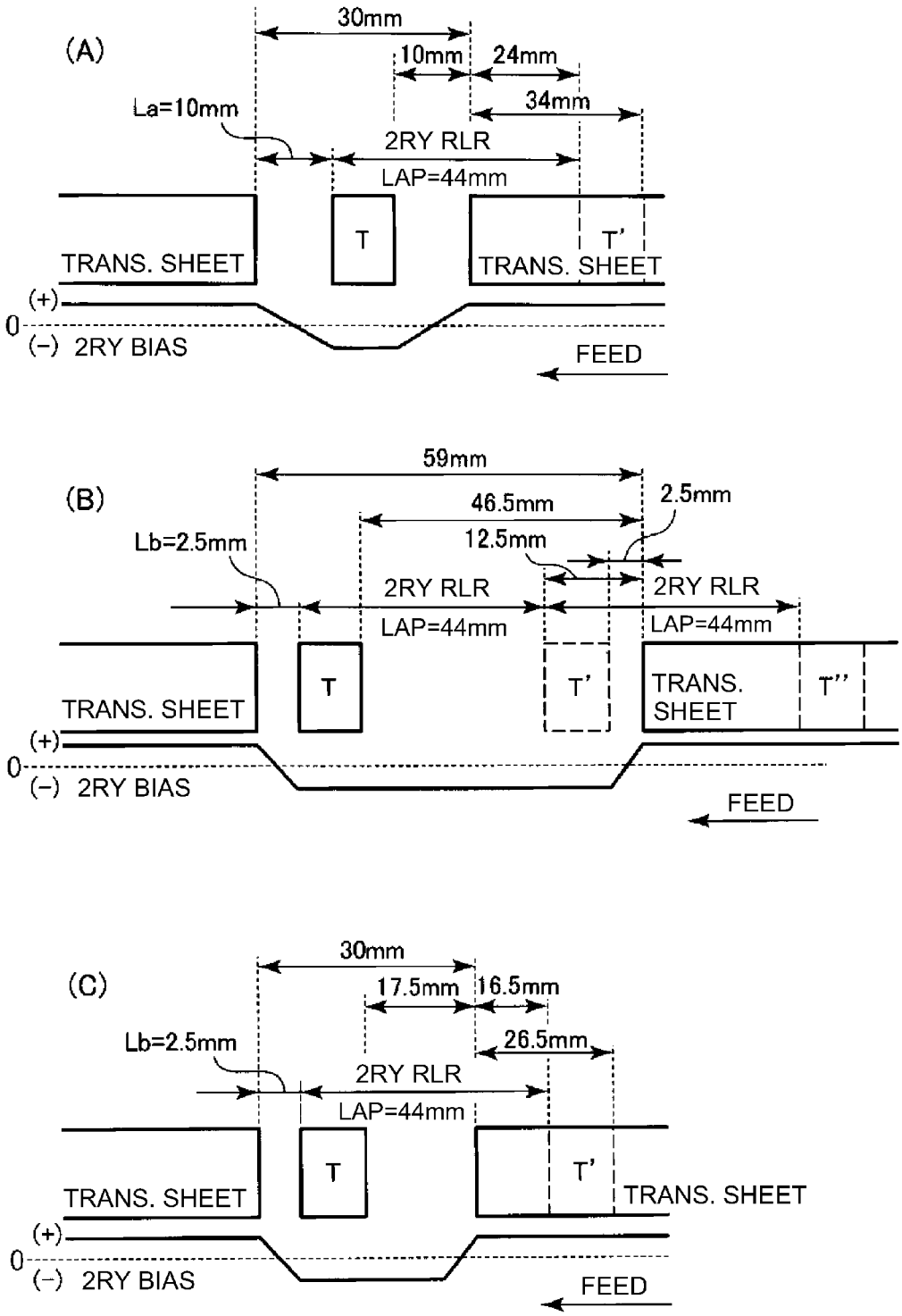
FIG. 5 is a schematic drawing for describing the positioning of the supply toner image, in the second embodiment of the present invention.

Next, referring to FIG. 5, the lubricant toner image formation position (where on the image bearing component a lubricant toner image is formed in this embodiment) is described in greater detail. FIG. 5 is a schematic drawing which is similar to FIG. 4. It is for describing the relationship between the image formation mode and lubricant toner image formation position in this embodiment.

Referring to FIG. 5(A), in the high speed mode (200 mm/sec), the distance between a lubricant toner image, and the immediately preceding transfer medium area, is set to 10 mm (=200 mm×0.05 sec).

In this case, the portion of the peripheral surface of the secondary transfer roller 8, which came into contact with the lubricant toner image, reaches again (position T' in drawing) the secondary transferring section N2 after a full rotation of the secondary transfer roller 8 after the formation (position T in drawing) of the lubricant toner image. This position T' is roughly 24 mm-34 mm on the rear side of the leading edge of the transfer medium area which immediately follows the lubricant toner image, as shown in FIG. 4(A). In this case, the laser-ON ratio is 0.2 as in the above-described first embodiment. Therefore, the back surface contamination of a sheet S of transfer medium is prevented.

By the way, in the high speed mode, the distance between a lubricant toner image and the transfer medium area which immediately follows the lubricant toner image is set to 10 mm. Therefore, the transfer medium area which immediately follows the lubricant toner image reaches the secondary transferring section N2 after the completion of the process for changing in polarity the voltage to be applied to the secondary transfer roller 8.

Next, referring to FIG. 5(B), in the low speed mode (50 mm/sec) in which glossy paper is used, the distance Lb between a lubricant toner image and the transfer medium area which immediately precedes the lubricant toner image is set to 2.5 mm (=50 mm/sec×0.05 sec).

In this case, if the length of the transfer medium interval area is left unchanged at 30 mm, the portion of the peripheral surface of the secondary transfer roller 8, which came into contact with the lubricant toner image, reaches again (position indicated by referential code T' in drawing) the secondary transferring section N2, after a full rotation of the secondary transfer roller 8 from the lubricant toner image formation position (indicated by referential code T in drawing), as shown in FIG. 5(C) which is described later. This position T' is on the rear side of the leading edge of the transfer medium area which immediately follows the lubricant toner image, by 16.5 mm-26.5 mm. Thus, if glossy paper is used, the back surface contamination of the sheet S becomes visually recognizable, as described in the foregoing regarding the first embodiment. In this embodiment, therefore, in a case where glossy paper is used in the low speed mode, the length of the transfer medium interval area is increased from 30 mm (for high speed mode) to 59 mm, as shown in FIG. 5(B).

Thus, the portion of the peripheral surface of the secondary transfer roller 8, which came into contact with a lubricant toner image, reaches again the secondary transferring section N2 after a full rotation of the secondary transfer roller 8 after the formation (indicated by referential code T in drawing) of the lubricant toner image, as shown in FIG. 5(B). This position (indicated by referential mode T' in drawing) is on the front side of the leading edge of the transfer medium area which immediately follows the lubricant toner image, by 12.5 mm-2.5 mm.

By the way, in a case where glossy paper is used in the low speed mode, the distance between a lubricant toner image and the transfer medium area which immediately follows the lubricant toner image is set to 46.5 mm. Therefore, the portion of the peripheral surface of the secondary transfer roller 8, which came into contact with the lubricant toner image, is allowed to come into contact with the intermediary transfer belt 7 after a full rotation of the secondary transfer roller 8. Also in a case where glossy paper is used in the low speed mode, the distance between the above-described position T' and the transfer medium area which immediately follows the position T' is set to 2.5 mm. Therefore, the transfer medium area which immediately follows the lubricant toner image reaches the secondary transferring section N2 after the completion of the process to be started after the passage of the lubricant toner image through the secondary transferring section N2, to change in polarity the voltage to be applied to the secondary transfer roller 8.

Further, by the time the portion of the peripheral surface of the secondary transfer roller 8, which came into contact with the lubricant toner image, comes into contact with a sheet S of transfer medium, in a position (indicated by referential code T" in drawing) after two full rotations of the secondary transfer roller 8, the laser-ON ratio will have been set to 0.2. Therefore, the back surface of the sheet S is not soiled to such an extent that the contamination is visually recognizable.

Figure 6:
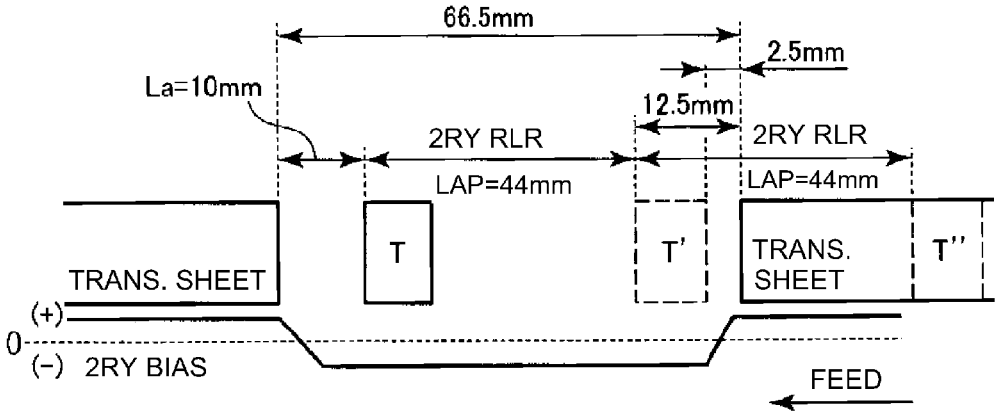
FIG. 6 is a schematic drawing for describing the positioning of the supply toner image, in a comparative image forming apparatus.

In this case, the distance between a lubricant toner image and the transfer medium area which immediately precedes the lubricant toner image was shortened. Therefore, the amount by which the transfer medium interval area is to be lengthened can be shortened by 7.5 mm, compared to a case where the transfer medium interval area is not shortened as in the case of a comparative case which is shown in FIG. 6. Therefore, even if the transfer medium interval area is reduced in length as in this embodiment, it is possible to prevent the back surface of a sheet S of transfer medium from being soiled when glossy paper is used in the low speed mode, while minimizing the throughput reduction which occurs as glossy paper is used in the low speed mode.

Referring to FIG. 5(C), also in a case where cardstock is used in the low speed mode (50 mm/sec), the distance Lb between a lubricant toner image and the transfer medium area which immediately precedes the lubricant toner image is set to 2.5 mm as in a case where glossy paper is used in the low speed mode.

In this case, if the length of the transfer medium interval area is left unchanged at 30 mm, the portion of the peripheral surface of the secondary transfer roller 8, which came into contact with a lubricant toner image, reaches again (position T' in drawing) the secondary transferring section N2 as the secondary transfer roller 8 rotates once after the formation (position T in drawing) of the lubricant toner image as shown in FIG. 5(C). This position T' is on the rear side of the leading edge of the transfer medium area which immediately follows the lubricant toner image, by 16.5 mm-26.5 mm (T" in drawing). In a case where cardstock is used, the laser-ON ratio is set to 0.2. Thus, even if a part of the lubricant toner image adheres the back surface of a sheet S of transfer medium after a full rotation the secondary transfer roller 8 after the contact between the secondary transfer roller 8 and lubricant toner image, the resultant contamination of the back surface of the sheet S is visually unrecognizable. Therefore, in this embodiment, in a case where cardstock is used in the low speed mode, the transfer medium interval area is not increased in length; it is set to 30 mm as in the high speed mode.

As described above, in this embodiment, the controlling section 150 changes in length the rear interval, that is, the interval between a lubricant toner image, and the transfer medium area which immediately follows the lubricant toner image, according to the type of transfer medium S to be delivered to the secondary transferring section N2, in the second mode (low speed mode). In particular, in this embodiment, the controlling section 150 makes the length of the rear interval greater when the surface smoothness of a sheet S of transfer medium to be delivered to the secondary transferring section N2 is at the second level, which is higher than the first level, than when the surface smoothness of the sheet S is at the first level. Therefore, it is possible to prevent the problem that in a case where cardstock is used in the low speed mode, the image forming apparatus reduces in throughput. That is, this embodiment makes it possible to prevent the back surface of the transfer medium S from being visually recognizably soiled, while minimizing the amount of productivity reduction, according to the image formation mode, and the type of a sheet S of transfer medium.

MISCELLANIES

In the foregoing, the present invention was described with reference to embodiments of the present invention. However, the preceding embodiments are not intended to limit the present invention in scope.

For example, in the above-described embodiments, an adjustment toner image was a lubricant toner image. However, these embodiments are not intended to limit the present invention in terms of the type of adjustment toner image. For example, the present invention is also applicable to a case in which an adjustment toner image is an image density correction patch (toner image) for correcting an image forming apparatus in image density, or a color deviation correction patch (toner image) for correcting an image forming apparatus in color deviation. The effects of the application of the present invention to image forming apparatuses which form an image density correction patch and/or color deviation correction patch are the same as those obtainable by the first embodiment.

Further, in the above-described embodiments, the secondary transfer voltage was applied to the secondary transfer roller, as a contacting component, which opposes the driver roller (which is in contact with the inward surface of the intermediary transfer belt, with reference to loop which intermediary transfer belt forms), and which is placed in contact with the outward surface of the intermediary transfer belt. As another method, an image forming apparatus may be structured so that one of a pair of secondary transfer rollers, as contacting components, is disposed as the outward roller which is placed in contact with the outward surface of the intermediary transfer belt to backs up the intermediary transfer belt, and such second transfer voltage that is the same in polarity as the toner charge is applied to the other secondary transfer roller which contacts the inward surface of the intermediary transfer belt. In this case, as the voltage to be applied to the secondary transfer inward roller is changed in polarity, an electric field which is opposite in direction from the electric field formed in the secondary transfer section during secondary transfer, can be formed in the secondary transfer section at least while the lubricant toner image is in contact with the secondary transfer which is in contact with the outward surface of the intermediary transfer belt.

Moreover, in the above-described embodiments, the image forming apparatus was of the so-called intermediary transfer type. However, these embodiments are not intended to limit the present invention in terms of the type of image forming apparatus. For example, the present invention is also applicable to the transferring section of an image forming apparatus of the so-called direct transfer type, which directly transfers a toner image formed on a photosensitive drum, onto transfer medium. The results of such application are the same as those obtainable by the preceding embodiments.

Further, in the above-described embodiments, the exposing means employed a laser. However, the present invention is also applicable to an image forming apparatus which employs other exposing means than a laser, for example, an LED or the like.

Furthermore, in the above-described embodiments, a lubricant toner image was formed on all the transfer medium interval areas, in a continuous image forming operation. However, it is unnecessary for a lubricant toner image to be formed on all the transfer medium interval areas. In a case where a lubricant toner image is not formed in all the transfer medium interval areas, it is only the transfer medium interval area on which a lubricant toner image is formed that has to be increased in length.

Further, a contacting component which is placed in contact with an image bearing component to form a transferring section does not need to be a roller. For example, the contacting component may be an endless belt, or a stationary component disposed so that as an image bearing component is moved, it slides on the contacting component. Further, the contacting component may be a pad, a brush, a stationary component in the form of a roller, or the like. Also in such a case, by controlling the adjustment toner formation position, as in the above-described embodiments, it is possible to increase the distance necessary to transfer the toner having adhered to a contacting component to the image bearing component. Therefore, it is possible to prevent the back surface contamination of a sheet of transfer medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-266594 filed on Dec. 26, 2014, which is hereby incorporated by reference herein in its entirety.

What is claimed is:

1. An image forming apparatus comprising:

a movable image bearing member configured to carry toner images;

a toner image formation unit configured to form toner images on said image bearing member;

a rotatable roller configured to form a transfer portion for transferring the toner images from said image bearing member onto transfer materials in contact with said image bearing member;

a controller configured to execute continuous image formation for continuously transferring the toner images onto transfer materials supplied to said transfer portion, said controller causing said toner image formation unit to form an adjustment toner image not to be transferred onto the transfer material in a region between adjacent transfer materials in the continuous image formation, the region being on said image bearing member between transfer material regions on said image bearing member which contact the transfer material in said transfer portion, wherein said controller executes the continuous image formation selectively in a first mode in which a portion of said roller contacting the adjustment toner image is contacted to the transfer material supplied to said transfer portion, after one full rotation of said roller, immediately after the adjustment toner image, or in a second mode in which a portion of said roller contacting the adjustment toner image is contacted to a portion of said image bearing member in the region between the transfer materials where the adjustment toner image is formed after one full rotation of said roller.

2. An apparatus according to claim 1, wherein a moving speed of said image bearing member in the second mode is lower than that in the first mode.

3. An apparatus according to claim 2, wherein said controller selects the first mode or the second mode on the basis of a kind of the transfer material supplied to said transfer portion.

4. An apparatus according to claim 1, wherein in a period in which at least the adjustment toner image is in contact with said roller, an electric field having a direction opposite the direction of an electric field formed in said transfer portion at the time when the toner image is transferred onto the transfer material from said image bearing member is formed in said transfer portion.

5. An apparatus according to claim 1, wherein said controller sets the length between the transfer materials in the second mode at a value which is greater than that in the first mode.

6. An apparatus according to claim 1, wherein the adjustment toner image is a half-tone image.

7. An apparatus according to claim 1, wherein the adjustment toner image supplies toner to a contact portion between said image bearing member and a cleaning member for cleaning a surface of said image bearing member.

8. An image forming apparatus comprising:

a movable image bearing member configured to carry toner images;

a toner image formation unit configured to form toner images on said image bearing member;

a rotatable roller configured to form a transfer portion for transferring the toner images from said image bearing member onto transfer materials in contact with said image bearing member; and a controller configured to execute continuous image formation for continuously transferring the toner images onto transfer materials supplied to said transfer portion, said controller causing said toner image formation unit to form an adjustment toner image not to be transferred onto the transfer materials in an interval region between adjacent transfer materials in the continuous image formation, the interval region being on said image bearing member between transfer material regions on said image bearing member which contact the transfer materials in said transfer portion, wherein said controller is capable of executing an operation in a first mode in which said image bearing member is moved at a first movement speed and in a second mode in which said image bearing member is moved at a second movement speed which is faster than the first movement speed, and wherein a distance between the adjustment toner image and a preceding transfer material region when the adjustment toner image is formed in the first mode is a first distance, and a distance between the adjustment toner image and the preceding transfer material region when the adjustment toner image is formed in the second mode is a second distance, and the second distance is longer than the first distance.

9. An apparatus according to claim 8, wherein in a period in which at least the adjustment toner image is in contact with said roller, an electric field having a direction opposite the direction of an electric field formed in said transfer portion at the time when the toner image is transferred onto the transfer material from said image bearing member is formed in said transfer portion.

10. An apparatus according to claim 8, wherein the adjustment toner image is a half-tone image.

11. An apparatus according to claim 8, wherein the adjustment toner image supplies toner to a contact portion between said image bearing member and a cleaning member for cleaning a surface of said image bearing member.

12. An apparatus according to claim 8, further comprising a photosensitive member configured to carry the toner images, wherein said image bearing member comprises an intermediary transfer belt onto which the toner images are primary-transferred from said photosensitive member.

* * * * *